US009599429B1

(12) United States Patent
Davis

(10) Patent No.: US 9,599,429 B1
(45) Date of Patent: Mar. 21, 2017

(54) ADJUSTABLE ERGONOMIC GRIP FOR A WEAPON

(71) Applicant: The United States of America as represented by the Secretary of the Navy, Washington, DC (US)

(72) Inventor: Jason M. Davis, Loogootee, IN (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 14/984,290

(22) Filed: Dec. 30, 2015

(51) Int. Cl.
*F41C 23/14* (2006.01)
*F41C 23/16* (2006.01)

(52) U.S. Cl.
CPC ..... *F41C 23/14* (2013.01); *F41C 23/16* (2013.01)

(58) Field of Classification Search
CPC ..... F41C 23/14; F41C 23/16; F41C 23/12
USPC ..... 42/71.01, 72; 89/1.42
See application file for complete search history.

(56) References Cited

U.S. PATENT DOCUMENTS

| | | | | |
|---|---|---|---|---|
| 4,300,302 | A | 11/1981 | Anschutz et al. | |
| 4,630,387 | A | 12/1986 | Crane et al. | |
| 5,417,002 | A | 5/1995 | Guerra | |
| 5,970,642 | A | 10/1999 | Martin | |
| 7,325,351 | B1 | 2/2008 | Leung | |
| 7,739,821 | B1 * | 6/2010 | Hamme | F41A 3/06 42/2 |
| 7,802,392 | B2 | 9/2010 | Peterson et al. | |
| 8,590,201 | B2 | 11/2013 | Brixius | |
| 8,752,323 | B2 | 6/2014 | Fulton et al. | |
| 8,857,094 | B2 | 10/2014 | Michel | |
| 9,010,008 | B2 | 4/2015 | Hovey | |
| 9,383,162 | B2 * | 7/2016 | Spykerman | F41C 23/14 |
| 2009/0193702 | A1 | 8/2009 | Lin | |
| 2009/0313873 | A1 * | 12/2009 | Roth | F41C 23/16 42/72 |
| 2014/0082983 | A1 | 3/2014 | Ermossa | |

FOREIGN PATENT DOCUMENTS

| | | | |
|---|---|---|---|
| DE | 2512027 | A1 | 9/1976 |
| DE | 102012107888 | A1 | 6/2014 |
| WO | WO 2004/015355 | A2 | 2/2004 |

OTHER PUBLICATIONS

Asymmetric Warrior® ASW338 Precision Tactical Rifle, Ashbury Precision Ordnance, Retrieved on Oct. 23, 2015: http://www.ashburyprecisionordnance.com/asymmetric-warrior-asw338/; 3 pages.

Johnson, Steve, ACCU-GRIP: An Adjustable AR-15 Pistol Grip, The Firearm Blog, Retrieved on Oct. 23, 2015: http://www.thefirearmblog.com/blog/2013/03/25/accu-grip-adjustable-ar-15-pistol-grip/; 8 pages.

(Continued)

*Primary Examiner* — Reginald Tillman, Jr.
(74) *Attorney, Agent, or Firm* — Christopher A. Monsey

(57) ABSTRACT

A handgrip for a firearm is provided for ergonomic angular adjustment. The ergonomic adjustable handgrip illustratively includes an attachment to a firearm, an upper grip portion, and a lower grip portion. The lower grip portion can be released by a push button, adjusted to a user preferred angle relative to the upper grip portion, and locked into the angle by releasing the push button.

15 Claims, 11 Drawing Sheets

(56) References Cited

OTHER PUBLICATIONS

BAD-ATG Adjustable Tactical Grip—Black—Firearms Accessories—Products / Battle Arms Development, Retrieved on Dec. 26, 2015: http://www.battlearmsdevelopment.com/bad-atg-adjustable-tactical-grip-black; 3 pages.
Archangel Opfor® Pistol Grip Conversion Stock for SKS Black—AASKS, HandgunGrips.com, Retrieved on Oct. 26, 2015: www.shopar15accessories.com/; 3 pages.
Hexmag Adjustable Angle Grip / SFP Tactical, Retrieved on Oct. 21, 2015: http://www.sfptac.com/product/hexmag-adjustable-angle-grip/; 1 page.
Ultimate Arms Gear Tactical GSG-5, retrieved on Oct. 26, 2015 from www.shopar15accessories.com/product/ultimate-arms-gear-tactical-gsg-5-gsg-gsg5-german-sport-gun-rifle-package-includes-tri-3-rail-handguard-weather; 3 pages.

* cited by examiner

ADJUSTABLE ERGONOMIC GRIP FOR A WEAPON

STATEMENT REGARDING FEDERALLY SPONSORED RESEARCH OR DEVELOPMENT

The invention described herein was made in the performance of official duties by employees of the Department of the Navy and may be manufactured, used and licensed by or for the United States Government for any governmental purpose without payment of any royalties thereon. This invention (Navy Case 200,004) is assigned to the United States Government and is available for licensing for commercial purposes. Licensing and technical inquiries may be directed to the Technology Transfer Office, Naval Surface Warfare Center Crane, email: Cran_CTO@navy.mil.

BACKGROUND AND SUMMARY OF THE INVENTION

The invention relates to firearms, and more particularly, to a firearm grip adjustable to a plurality of angular positions.

Adjustable grips for firearms are known in the art. Conventional firearm grips typically have standard sizes with set grip angles. A desired grip angle is often determined by the shooter's ability to fire the firearm with the center of mass of the shooter's hand aligned with the shooter's forearm with little to no wrist movement. More particularly, the desired grip angle is typically determined by what best accommodates shooting in a traditional rifle stance or in a squared tactical stance. With a traditional rifle stance, the shooter's weak side shoulder faces an opponent. With a squared tactical stance, the shooter's shoulders and torso are facing the target.

In both instances, the buttstock of the rifle is either placed near the centerline of the body or high up on the chest with elbows down or tucked-in. This results in ulnar deviation of the wrist which may lead to wrist fatigue and injury. While adjustable grips are available in the prior art, none are known to effectively correct for ulnar deviation present in currently used shooting stances, nor are easily and quickly adjustable in the field.

Therefore, there remains a need in the art to provide a field adjustable handgrip for firearms that effectively accommodates different shooting stances.

According to an illustrative embodiment of the present disclosure a firearm includes a body with a barrel extending along a longitudinal barrel axis, and a handgrip extending along a grip axis downwardly from the longitudinal barrel axis. The handgrip includes an upper grip portion coupled to the body, and a lower grip portion operably coupled to the upper grip portion for angular adjustment along a pivot axis extending perpendicular to the longitudinal barrel axis and the grip axis. A locking device is configured to move between a locked position and an actuated position, the locking device in the locked position secures the lower grip portion in one of a plurality of different angular positions relative to the upper grip portion, and the locking device in the actuated position permits rotational movement of the lower grip portion relative to the upper grip portion. A push button is supported by the lower grip portion and configured to move the locking device from the locked position to the actuated position.

According to a further illustrative embodiment of the present disclosure, an adjustable handgrip for a firearm includes an upper grip portion, a lower grip portion, a button, a locking device, a spring, and a button. The upper grip portion attaches to the firearm and has a downwardly extending lobe with a first pivot opening. The lower grip portion has an upwardly extending lobe with a second pivot opening. The first pivot opening and the second pivot opening are coaxially aligned so that the lower grip portion is angularly adjustable along the pivot opening axis relative to the upper grip portion. The button is coaxially aligned with the pivot axis within the first and second pivot openings. The locking device is operably coupled to the lower grip portion and is configured to move between a first position and second position. The locking device in the first position secures the lower grip portion in one of a plurality of different angular positions relative to the upper grip portion. The locking device in the second position releases the lower grip portion for angular adjustment relative to the upper grip portion. The spring is configured to bias the locking device along the pivot axis toward the first position, and the button is operably coupled to the locking device. When the button is depressed, it biases the spring and moves the locking device along the pivot axis toward the second position.

According to another illustrative embodiment of the present disclosure, a method of assembling an adjustable grip for a firearm includes the steps of providing a firearm, and coupling an upper grip portion of an adjustable handgrip to the firearm. The method further includes the steps of providing a lower grip portion, where first and second outer lobes are supported by one of the upper grip portion or the lower grip portion, the first outer lobe including a first pivot opening and the second outer lobe including a second pivot opening, and a center lobe supported by the other of the lower grip portion or the upper grip portion, the center lobe including a third pivot opening. The method further includes the steps of inserting a spring within the second pivot opening of the second outer lobe, inserting a locking device between the first and second outer lobes to bias against the spring, inserting the center lobe intermediate the first and second outer lobes, aligning the third pivot opening with the first and second pivot openings, and inserting a button within the aligned first and third pivot openings.

According to another illustrative embodiment of the present disclosure, a method of operating an adjustable handgrip for a firearm includes the steps of providing a firearm and an adjustable handgrip with an upper grip portion, a lower grip portion, and a button, and depressing the button to an actuated position, wherein a locking device releases the lower grip portion for rotational movement relative to the upper grip portion about a pivot axis. The method further includes the steps of rotating the lower grip portion of the adjustable grip relative to the upper grip portion about the pivot axis to a user desired angle of use, and releasing the button wherein the locking device is biased to a locked position to secure the lower grip portion at the user desired angle relative to the upper grip portion of the adjustable handgrip.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The foregoing aspects and many of the attendant advantages of this invention will become more readily appreciated as the same become better understood by reference to the following detailed description when taken in conjunction with the accompanying drawings.

DETAILED DESCRIPTION OF THE DRAWINGS

Figure 1:
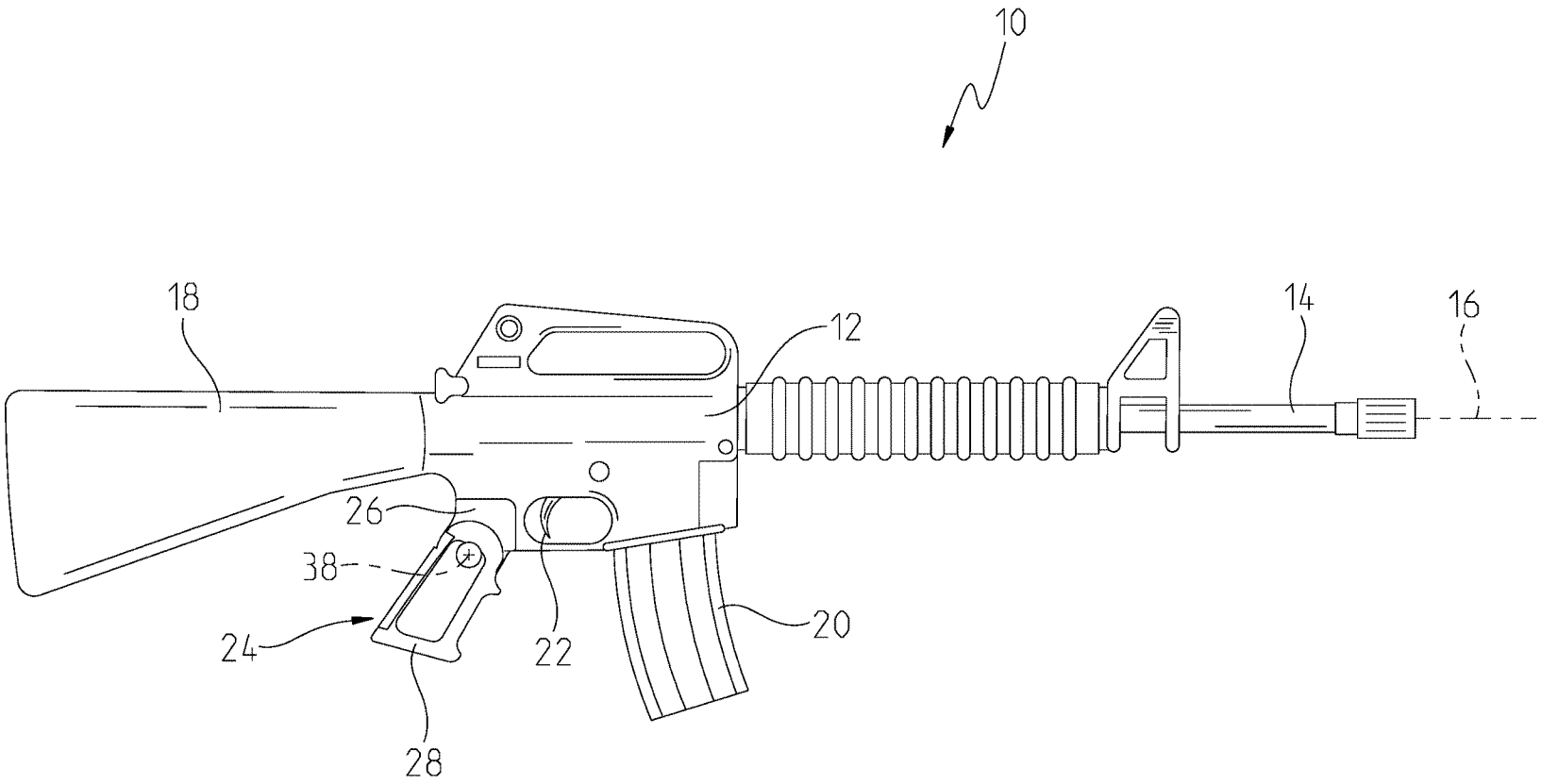
FIG. 1 is a side elevational view of an illustrative adjustable firearm grip coupled to a firearm.

For the purposes of promoting an understanding of the principles of the invention, reference will now be made to the embodiments illustrated in the drawings, which are described below. The embodiments disclosed below are not intended to be exhaustive or limit the invention to the precise form disclosed in the following description. Rather, the embodiments are chosen and described so that others skilled in the art may utilize their teachings. It will be understood that no limitation of the scope of the invention is thereby intended. The invention includes any alterations and further modifications in the illustrated devices and described methods and further applications of the principles of the invention which would normally occur to one skilled in the art to which the invention relates.

Figure 1A:
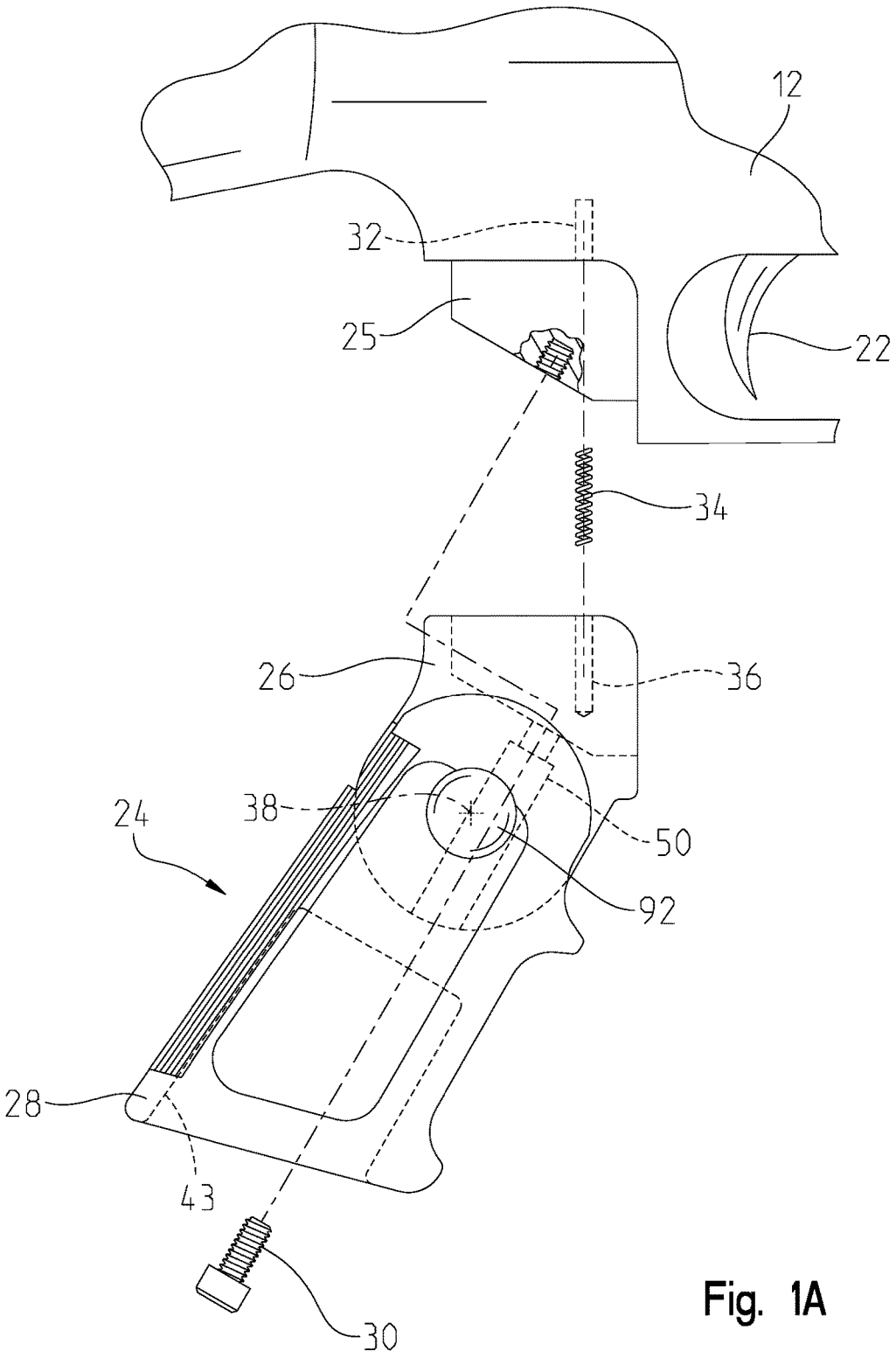
FIG. 1A is a detailed view of FIG. 1, showing the mounting of the illustrative adjustable firearm grip to the receiver body of the firearm.

Referring initially to FIGS. 1 and 1A, an illustrative firearm 10 includes a receiver body 12, a barrel 14 supported by the receiver body 12 and extending forwardly along a longitudinal barrel axis 16, and a buttstock 18 extending rearwardly from the receiver body 12. An ammunition cartridge 20, a trigger 22, and a handgrip 24 are supported by the receiver body 12. The illustrative firearm 10 shown in the drawings is a long gun or rifle, such as an M16 rifle or an M4 carbine rifle. However, it should be appreciated that the present invention may be used with a wide variety of conventional firearms.

Figure 2:
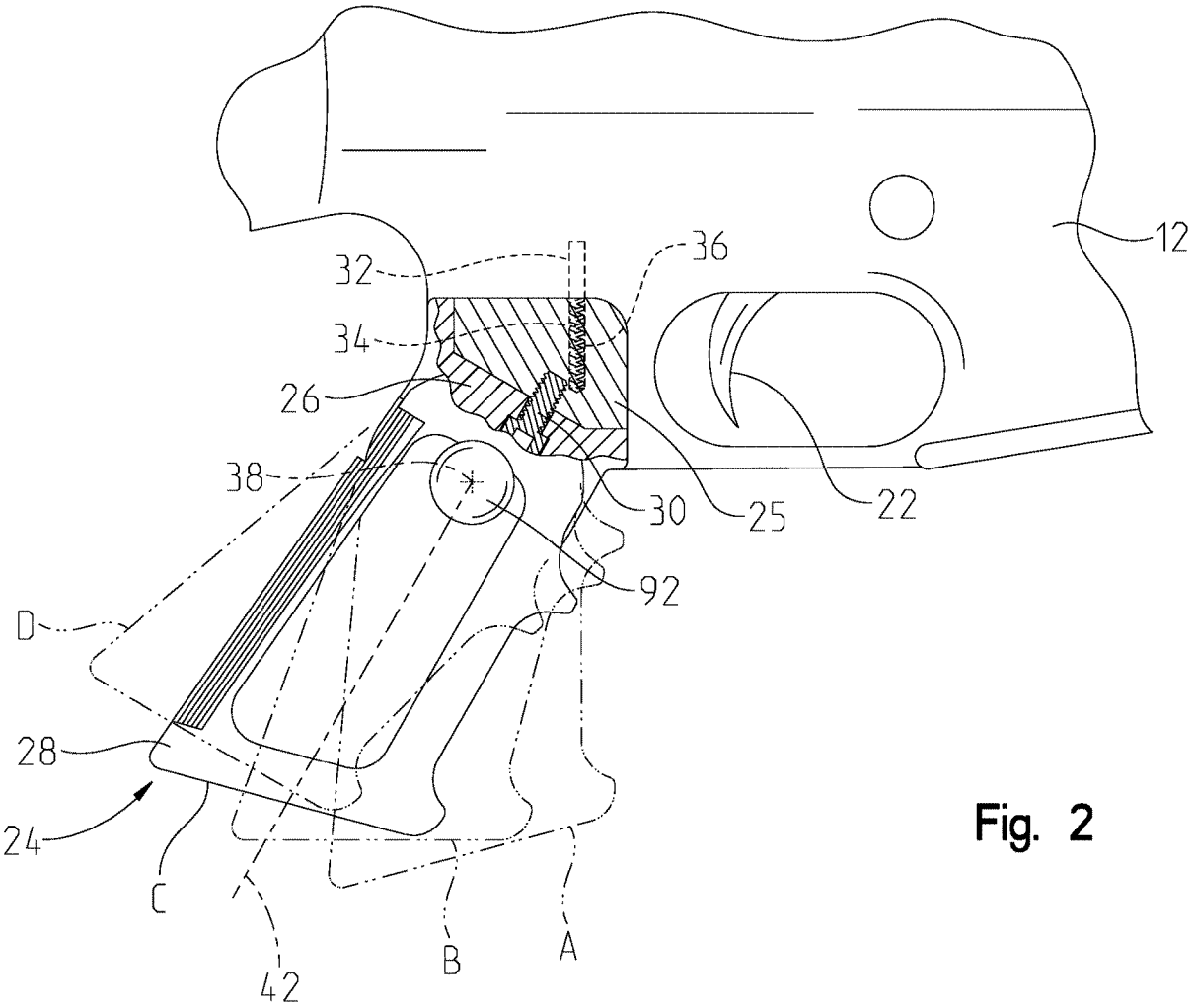
FIG. 2 is a detailed side elevational view of FIG. 1 showing the illustrative adjustable firearm grip positioned in a multitude of angular positions.
Figure 4:
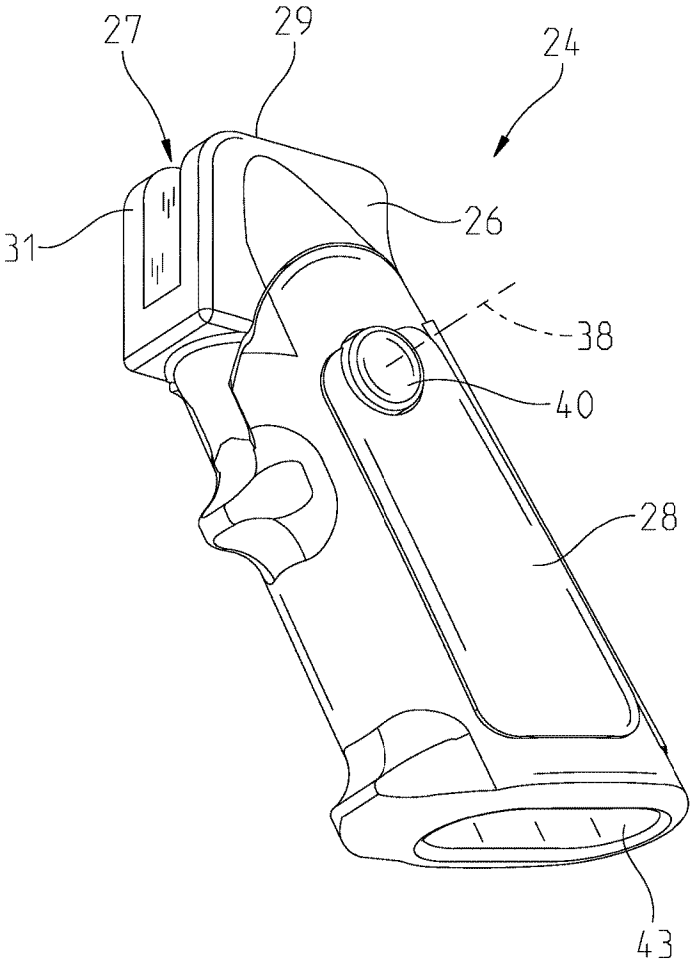
FIG. 4 is second perspective view of the adjustable firearm grip of FIG. 1.
Figure 3:
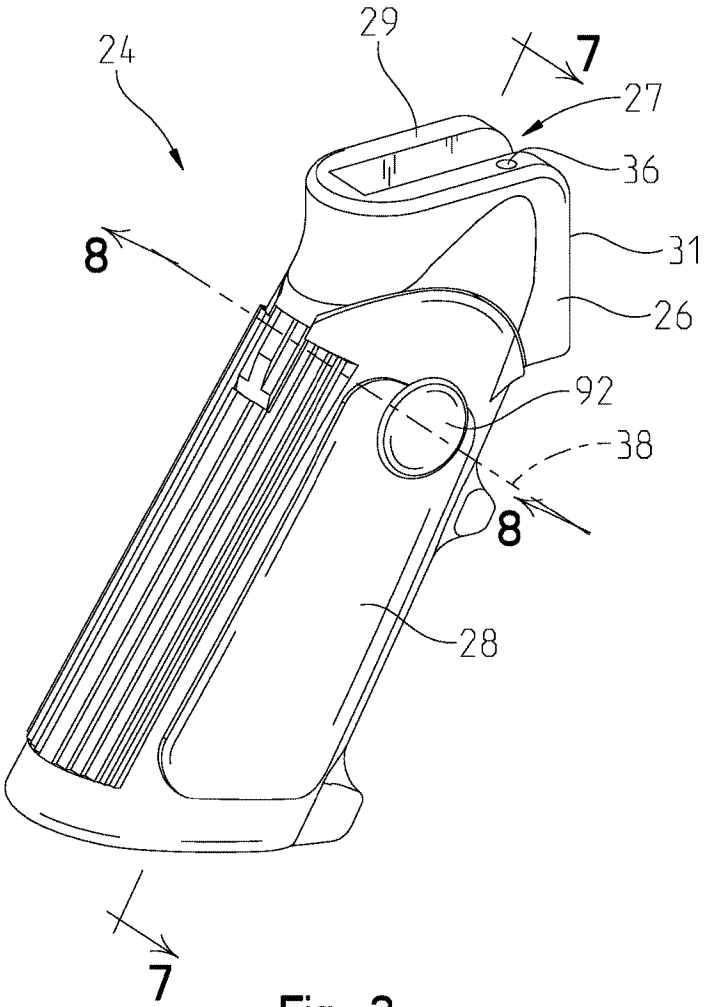
FIG. 3 is a first perspective view of the adjustable firearm grip of FIG. 1.

With reference to FIGS. 2-4, the handgrip 24 is attached to a portion of the receiver body 12 adjacent to the trigger 22, and includes an upper grip portion 26 and a lower grip portion 28. In an illustrative embodiment, the upper grip portion 26 is attached to the receiver body 12 by use of a conventional fastener, such as a machine screw 30. More particularly, a lower receiver mounting tab 25 of the receiver body 12 is secured within a slot or channel 27 of the upper grip portion 26. The channel 27 is defined by arms 29 and 31 of the upper grip portion 26.

A safety selector detent 32 and safety selector detent spring 34 are illustratively received within a bore 36 extending between the receiver body 12 and the upper grip portion 26 proximate the machine screw 30. The screw 30 extends through the channel 27 of the upper grip portion 26, while the bore 36 extends within the arm 31 of the upper grip portion 26. It should be appreciated that the detent spring 34 is captured within the bore 36 between the receiver body 12 and the upper grip portion 26. As further detailed herein, the lower grip portion 28 may be adjusted without removing the upper grip portion 26, which could result in the loss of the detent spring 34.

With further reference to FIGS. 2-4, the lower grip portion 28 is coupled to the upper grip portion 26 along a pivot axis 38 and can be secured in a plurality of angular positions through operation of a user interface, such as a push button 40. The lower grip portion 28 illustratively defines a grip axis 42 extending perpendicular to the pivot axis 38. Illustratively, the grip axis 42 extends generally downwardly from the barrel axis 16. As further detailed herein, depending upon the angular orientation of the lower grip portion 28, the grip axis 42 may extend substantially perpendicular to the barrel axis 16, substantially parallel to the barrel axis 16, and in a variety of discrete positions therebetween. A cavity 43 may extend along the grip axis 42 and open downwardly within the lower grip portion 28 to provide a space for storage.

The lower grip portion 28 may be angularly adjusted about pivot axis 38 between a plurality of positions A, B, C and D from a forward position A (where grip axis 42 extends substantially vertical) rearwardly (clockwise in FIG. 2) to a rearward position D. Illustratively, each position A, B, C, D is offset by approximately 15 degrees from each adjacent position A, B, C, D, such that the total range of angular adjustment from position A to position D is approximately 45 degrees. It should be appreciated that the number and degree of incremental angular adjustments, along with the total range of angular adjustment, may vary. For example, in one illustrative embodiment the lower grip portion 28 may be rotated rearwardly by 90 degrees from downward position A shown in FIG. 2 to a rearward or stowed position, such that the grip axis 42 extends parallel to the barrel axis 16, thereby providing a compact arrangement for carrying or concealing the firearm 10.

Figure 5:
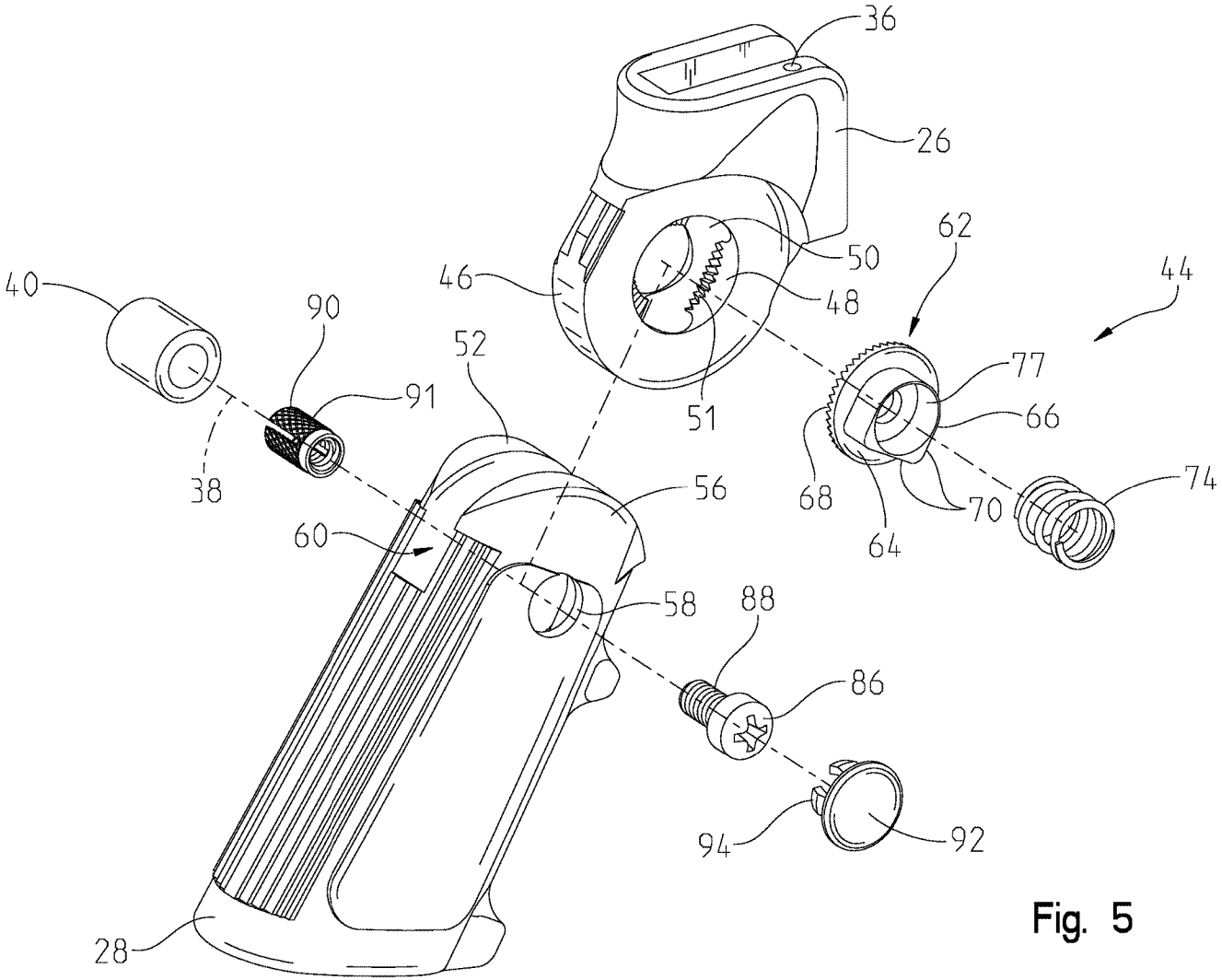
FIG. 5 is a first exploded view of the adjustable firearm grip of FIG. 1.
Figure 6:
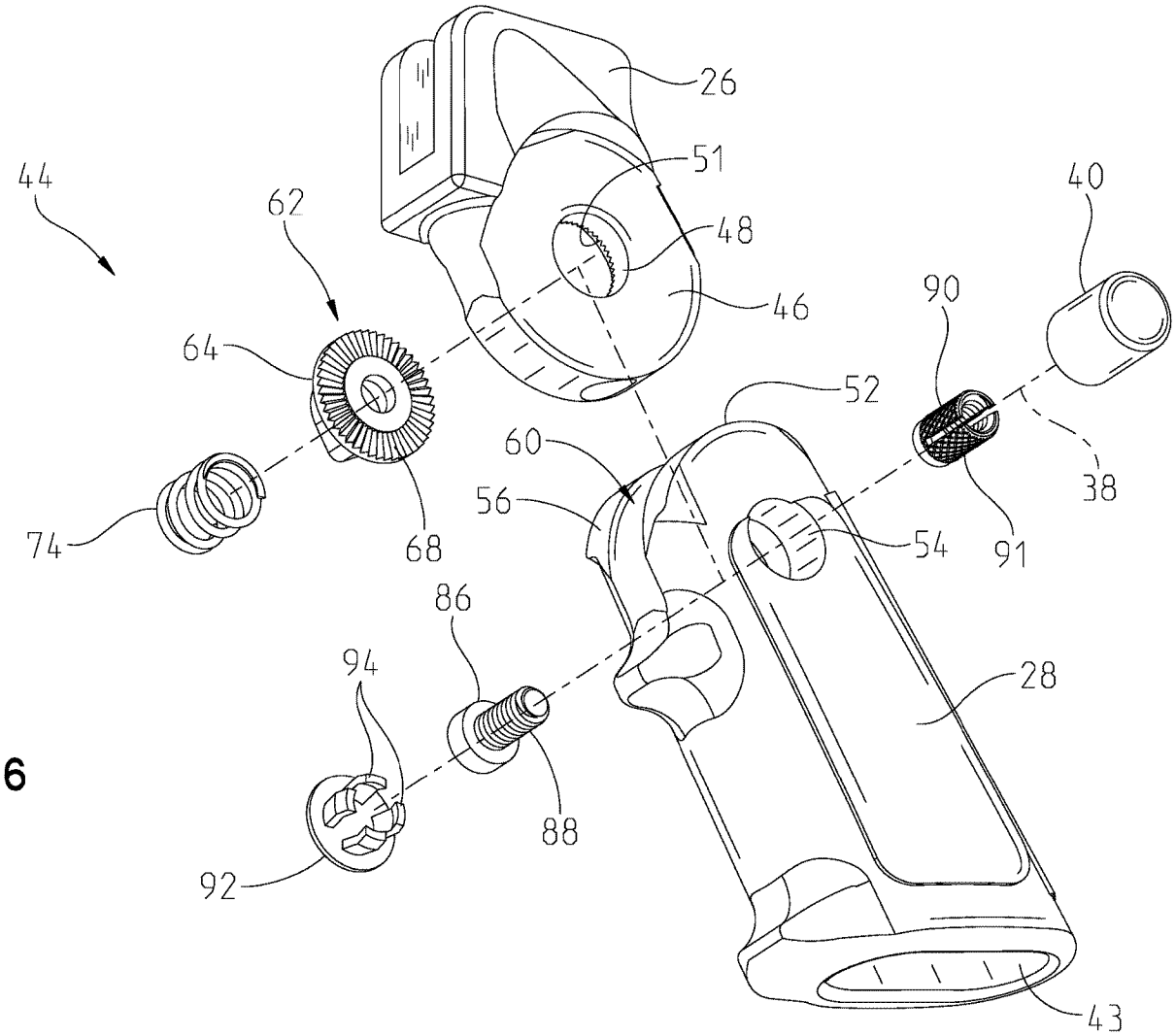
FIG. 6 is a second exploded view of the adjustable firearm grip of FIG. 1.

With reference to FIGS. 5 and 6, the illustrative handgrip 24 includes a locking device 44 configured to secure the lower grip portion 28 in one of the plurality of different angular positions A, B, C, D relative to the upper grip portion 26. The push button 40 is configured to release the locking device 44 in response to a user input, illustratively by depressing the push button 40. In certain illustrative embodiments, indicia may be provided on the lower grip portion 28 in a dial type arrangement surrounding the push button 40, wherein a mark on the push button 40 aligns with the indicia to provide the user with an indication of the selected angular orientation of the lower grip portion 28 relative to the upper grip portion 26.

Figure 8:
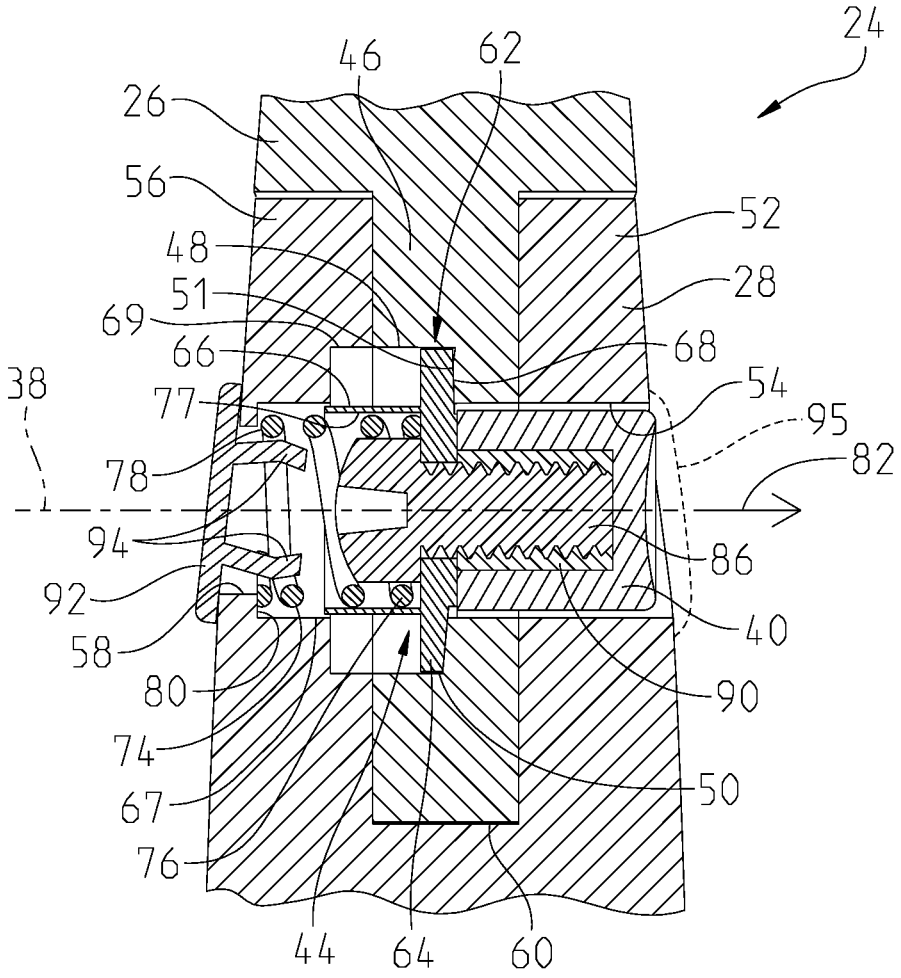
FIG. 8 is a cross-sectional view of the adjustable firearm grip taken along line 8-8 of FIG. 3, showing the locking device in a static or locked position, with the push button biased in a first direction.
Figure 9:
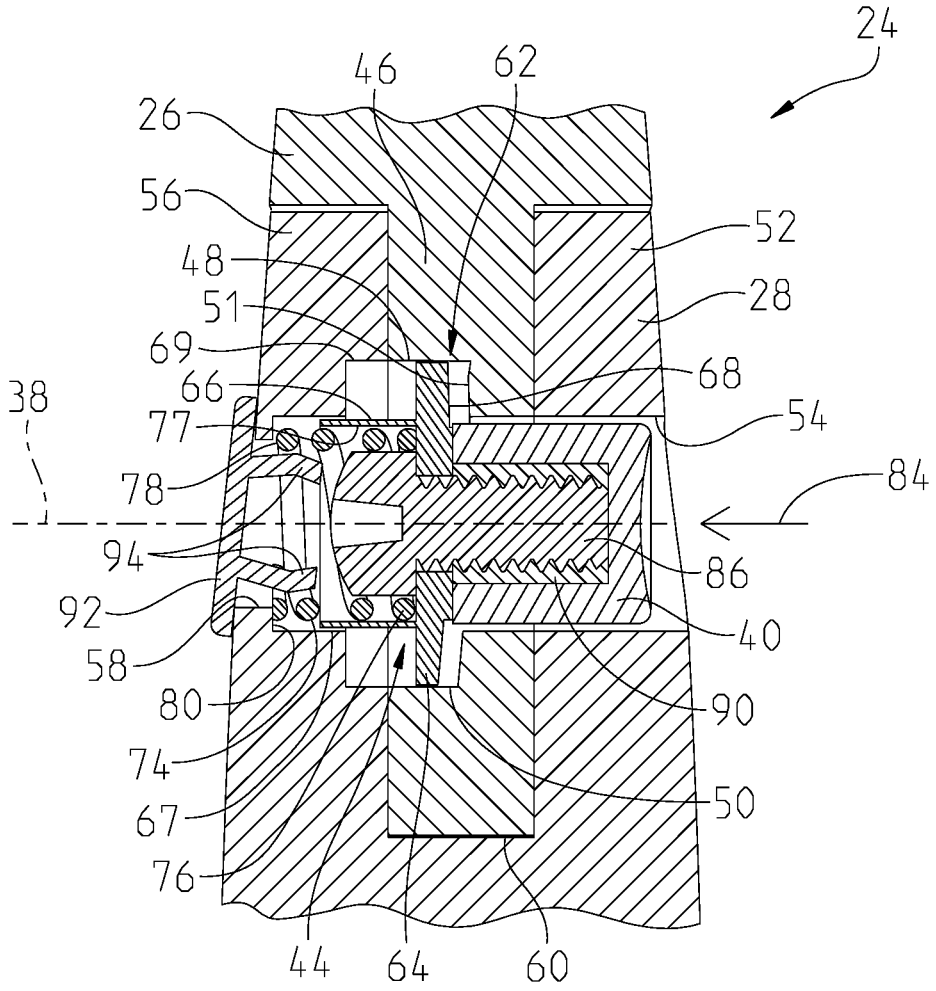
FIG. 9 is a cross-sectional view of the adjustable firearm grip taken along line 8-8 of FIG. 3, showing the locking device in an actuated or locked position, with the push button biased in a second direction.

One illustrative embodiment of the locking device 44 is shown in FIGS. 8 and 9. The upper grip portion 26 has a downwardly extending center arm or lobe 46 with a first pivot opening 48. The first pivot opening 48 of the downwardly extending center lobe 46 includes a counterbore 50 including a plurality of circumferentially spaced lugs or teeth 51. The teeth 51 are illustratively arranged in a ring and are co-axially aligned with the first pivot opening 48 about pivot axis 38. The lower grip portion 28 has an upwardly extending first outer arm or lobe 52 with a second pivot opening 54, and an upwardly extending second outer arm or lobe 56 with a third pivot opening 58. The first lobe 52 and the second lobe 56 of the lower grip portion 28 are in spaced relation to each other to define a center channel or slot 60 to receive the downwardly extending center lobe 46 of the upper grip portion 26. As further detailed herein, the third pivot opening 58 of the upwardly extending second lobe 56 includes outer counterbore 67 and inner counterbore 69.

The first pivot opening 48, the second pivot opening 54, and the third pivot opening 58 are coaxially aligned along the pivot axis 38. A locking drum 62 is operably coupled to the lower grip portion 28, and is configured to move axially along the pivot axis 38 between a first, static or locked position (FIG. 8), and a second, actuated or released position (FIG. 9). More particularly, the locking drum 62 includes a disc shaped body 64 having a first side supporting a protrusion or guide sleeve 66, and a second side supporting a plurality of circumferentially spaced lugs or teeth 68.

Figure 7:
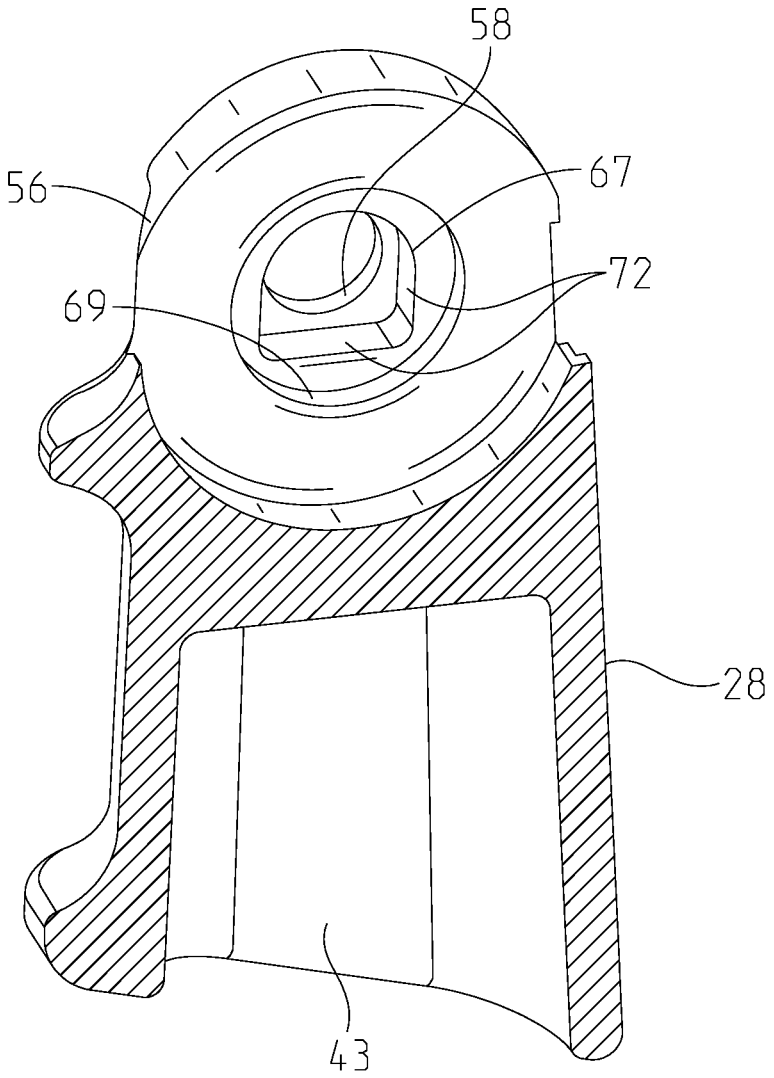
FIG. 7 is a cross-sectional view of the adjustable firearm grip taken along 7-7 of FIG. 3.

With reference to FIGS. 5-7, the protrusion 66 of the locking drum 62 is illustratively asymmetric, such as a non-concentric shaped wall. The non-concentric shaped protrusion 66 is axially aligned with the third pivot opening 58 of the lobe 56 of the lower grip portion 28. Insertion of the non-concentric protrusion 66 into the inverse non-concentric shaped counterbore 67 of the lobe 56 prevents the rotation of the locking drum 62 relative to the lower grip portion 28. The illustrative protrusion 66 is D-shaped and includes a plurality of anti-rotation flats 70 configured to cooperate with flats 72 in the counterbore 67 of the lower grip portion 28, which is also D-shaped, thereby preventing rotation of the locking drum 62 relative to the lower grip portion 28.

A spring 74 includes a first end 76 received within an opening 77 defined by the protrusion 66, and a second end 78 engaging a lip 80 defined within the second pivot opening of the second lobe 56. The spring 74 biases against the locking drum 62 axially along a first direction toward the first lobe 52 (as shown by arrow 82 in FIG. 8), thereby securing the lower grip portion 28 in one of a plurality of angular positions. In this first, static or locked position of the locking device 44, the circumferentially spaced locking teeth 68 of the locking drum 62 are engaged with the cooperating teeth 51 of the upper grip portion 26. When the spring 74 is compressed axially in a second direction (as shown by arrow 84 in FIG. 9) by depressing the push button 40, the locking drum 62 is in axially moved away from the first lobe 52, wherein the lower grip portion 28 can be adjusted to a different angular position relative to the upper grip portion 26. In this second, actuated or released position of the locking device 44, the circumferentially spaced locking teeth 68 of the locking drum 62 are disengaged from the cooperating teeth 51 of the upper grip portion 26.

With further reference to FIGS. 5 and 6, the push button 40 is secured to the locking drum 62 via a fastener, such as a drum screw 86. More particularly, the threaded shank 88 of the drum screw 86 is coupled to a threaded insert 90 which is coupled to the push button 40, illustratively through a friction fit. More particularly, the threaded insert 90 may be a split sleeve 91 that receives the screw 86 and expands within the push button 40 as the screw 86 is threaded therein. Outer surface of the sleeve 91 may include a textured outer surface to increase frictional engagement between the insert 90 and the push button 40.

FIGS. 5 and 6 illustrate an embodiment where the spring 74 is biased by second end 78 engaging the lip 80 within the pivot opening 58. A cap or plug 92 includes retention arms 94 that are received within the first end 76 of the spring 74. The cap 92 is configured to cover the pivot opening 58 in the lower grip portion 28, thereby preventing debris from entering the locking device 44. A flexible elastomeric membrane 95 (FIG. 8) may be placed over the outer end of the push button 40 to prevent debris from entering the locking device 44.

FIG. 8 illustrates the locking device 44 in the first, static or locked position where the locking drum 62 secures the lower grip portion 28 in a desired angular position relative to the upper grip portion 26. More particularly, the spring 74 biases the locking drum 62 in the direction of arrow 82, thereby forcing the teeth 68 of the locking drum 62 into axial engagement with the cooperating teeth 51 of the upper grip portion 26. FIG. 9 illustrates the locking device 44 in the second, actuated or released position where the locking drum 62 releases the lower grip portion 28 for angular adjustment relative to the upper grip portion 26 around the pivot axis 38. More particularly, a force applied by a user to push button 40 in the direction of arrow 84 (i.e., depressing the push button 40), forces the teeth 68 of the locking drum 62 away from the cooperating teeth 51 of the upper grip portion 26. It should be appreciated that the size and spacing of the teeth 51 of the upper grip portion 26 and the teeth 68 of the locking drum 62 determine the number and angular dimensions of available positions of the lower grip portion 28 relative to the upper grip portion 26.

Figure 10:
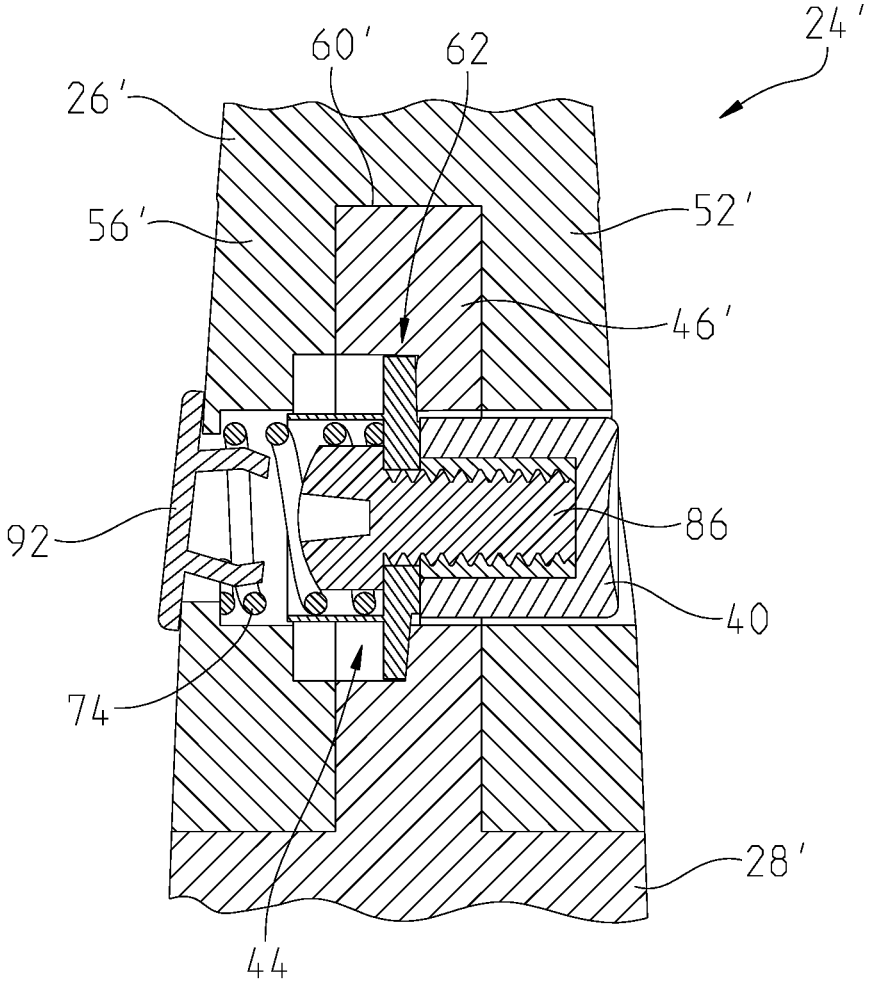
FIG. 10 is a cross-sectional view similar to FIG. 8 showing an alternative arrangement of the lower portion coupled to the upper portion.

FIG. 10 shows a further illustrative embodiment handgrip 24' where the lower grip portion 28' includes an upwardly extending center arm or lobe 46' received within a slot or channel 60' defined by first and second arms or lobes 52' and 56' extending downwardly from the upper grip portion 26'.

Figure 11:
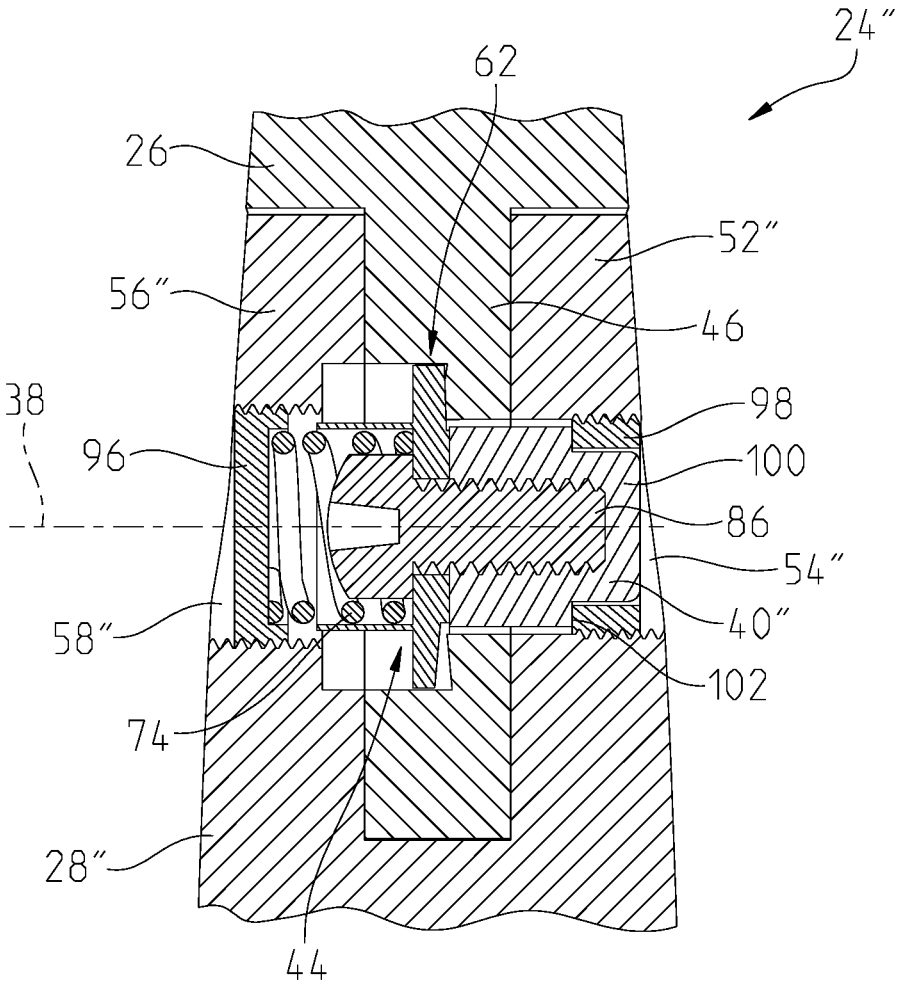
FIG. 11 is a cross-sectional view similar to FIG. 8 showing an alternative means of retaining the button and locking device.

FIG. 11 shows another illustrative embodiment handgrip 24" including a spring retention cap 96 and a button retention cap 98. The spring retention cap 96 is threadably received within the pivot opening 58" of the lobe 56". The spring 74 is retained along the pivot axis 38 between the locking drum 62 and the spring retention cap 96. The button retention cap 98 is threadably received within the pivot opening 54" of the lobe 52" and concentrically receives a reduced diameter end portion 100. A lip 102 is defined by the end portion 100 and engages the button retention cap 98 to axially retain the push button 40" within the lower grip portion 28".

With further reference to FIGS. 1-6, an illustrative assembly method of the handgrip 24 will be further detailed. The illustrative assembly method includes the steps of coupling the upper grip portion 26 to the receiver body 12 of the firearm 10. More particularly, the safety selector detent 32 and the safety selector detent spring 34 are illustratively received within the bore 36. The upper grip portion 26 receives the mounting tab 25 of the receiver body 12 and is secured to the receiver body 12 by the screw 30.

The assembly method continues by axially compressing the spring 74 and inserting it within the center slot 60 of the lower grip portion 28, with the second end 78 of the spring 74 engaging the lip 80 of the second lobe 56. With the spring 74 still compressed, the locking drum 62 is then placed within the center channel 60 of the lower grip portion 28, with the locking teeth 68 facing toward the teeth 51 of the first lobe 52. The opening 77 within the locking drum 62 receives and engages radially with the first end 76 of the spring 74. The anti-rotation flats 70 of the protrusion 66 cooperate with flats 72 in the counterbore 67 of the lower grip portion 28, thereby preventing rotation of the locking drum 62 relative to the lower grip portion 28. With the spring 74 compressed and the locking drum 62 fully depressed within counterbore 69, the assembly method continues by inserting the center lobe 46 of the upper grip portion 26 within the channel 60 intermediate the first outer lobe 52 and the second outer lobe 56 of the lower grip portion 28. The first pivot opening 48 of the center lobe 46 is aligned with the second pivot opening 54 and the third pivot opening 58. When properly aligned, locking teeth 68 of the locking drum 62 will engage or mesh with cooperating teeth 51 in the center lobe 46.

Next, the threaded insert 90 is inserted within the push button 40, and then inserted into the aligned second pivot opening 54 of the first outer lobe 52 and the first pivot opening 48 of the center lobe 46. The screw 86 is then inserted through the third pivot opening 58 of the second outer lobe 56 and threaded into the insert 90, thereby securing the locking drum 62 to the push button 40. The cap 92 is then inserted within the third pivot opening 58 of the second outer lobe 56, where the arms 94 are secured within the first end 76 of the spring 74.

A further embodiment of assembling the handgrip 24" as illustrated by FIG. 11 includes threadably inserting the spring retention cap 96 into the opening 58" of the lobe 56" to engage the spring 54 and bias it in a second direction away from the cap 96. A further embodiment of assembling the handgrip 24" includes threadably inserting the push button retention cap 98 into the lobe 54" to engage the push button 40.

With further reference now to FIGS. 1-6, an illustrative operating method of the handgrip 24 will be further detailed. In the static or locked position of the locking device 44, the lower grip portion 28 is secured from moving relative to the upper grip portion 26. More particularly, the teeth 68 of the locking drum 62 engage with the teeth 51 of the upper grip portion 26 to prevent relative rotation therebetween (FIG. 8). The illustrative operating method includes the steps of the user depressing the push button 40 to move the locking device 44 to the actuated or released position, wherein the locking device 44 releases the lower grip portion 28 for rotational movement about the pivot axis 38 relative to the upper grip portion 26. More particularly, the teeth 68 of the locking drum 62 are moved into axially spaced relation to the teeth 51 of the lower grip portion 28 to permit relative rotation therebetween (FIG. 9).

The operating method continues by the user rotating the lower grip portion 28 of the handgrip 24 relative to the upper grip portion 26 to the user preferred angle of use, while continuing to depress the push button 40. Next, the user releases the push button 40 thereby causing the locking device 44 to return to the static or locked position (FIG. 8). More particularly, the teeth 68 of the locking drum 62 are biased by the spring 74 toward the teeth 51 of the upper grip portion 26. As such, the lower grip portion 28 is secured at the user desired angle relative to the upper grip portion 26.

As may be appreciated, the adjustable handgrip 24 provides an ability to change the grip angle of the lower grip portion 28 and better accommodate different shooting stances, and to make slight incremental adjustments of the grip angle of the lower grip portion 28 while in the field. By rotating the lower grip portion 28 relative to the upper grip portion 26 of the handgrip 24, wrist fatigue and injury can be minimized by permitting the shooter to hold the firearm 10 at or closer to a natural wrist position. If desired, one available position could be to fold the upper grip portion 26 of the handgrip 24 upwardly for more compactness while being carried and/or concealed.

Although the invention has been described in detail with reference to certain preferred embodiments, variations and modifications exist within the spirit and scope of the invention as described and defined in the following claims.

The invention claimed is:

1. A firearm comprising:

a body including a barrel extending along a longitudinal barrel axis;

a handgrip extending along a grip axis downwardly from the longitudinal barrel axis, the handgrip including:

an upper grip portion coupled to the body;

a lower grip portion operably coupled to the upper grip portion for angular adjustment along a pivot axis extending perpendicular to the longitudinal barrel axis and the grip axis;

a locking device configured to move parallel with the pivot axis between a locked position and an actuated position, the locking device in the locked position securing the lower grip portion in one of a plurality of different angular positions around the pivot axis relative to the upper grip portion, and the locking device in the actuated position permitting rotational movement of the lower grip portion relative to the upper grip portion; and a push button supported by the lower grip portion and configured to move the locking device from the locked position to the actuated position, wherein the locking device includes:

a locking drum coupled to the lower grip portion and including a plurality of circumferentially spaced locking teeth; and wherein the upper grip portion includes a plurality of circumferentially spaced cooperating teeth configured to engage with the locking teeth of the locking drum.

2. The firearm of claim 1 further comprising a spring operably coupled to the locking device, wherein the locking device is configured to move axially along the pivot axis between a first position and a second position, wherein the locking device in the first position secures the lower grip portion in one of the plurality of different angular positions relative to the upper grip portion, and the locking device in the second position releases the lower grip portion for angular adjustment relative to the upper grip portion about the pivot axis, the spring being configured to bias the locking device along the pivot axis toward the first position.

3. The firearm of claim 2 further comprising a button retainer section configured to limit axial movement of the button and the locking device in a direction from the second position toward the first position.

4. The firearm of claim 3, wherein the button retainer section includes:

a button retention cap opening supported by the lower grip portion and coaxially aligned along the pivot axis; and a button retention cap coaxially aligned along the pivot axis within the button retention cap opening and operably coupled to the button.

5. The firearm of claim 2, including:

a spring retenter coaxially aligned along the pivot axis and secured to the lower grip portion;

wherein the spring includes a first end engaging the spring retainer and a second end engaging the locking device.

6. An adjustable handgrip for a firearm comprising:

an upper grip portion configured to be secured to a body of the firearm, the body including a barrel extending along a longitudinal barrel axis, wherein the upper grip is coupled with the body so as to extend away from the longitudinal barrel axis along a grip axis, the upper grip portion including a downwardly extending lobe along the grip axis and having a first pivot opening;

a lower grip portion including an upwardly extending lobe having a second pivot opening, the first pivot opening and the second pivot opening being coaxially aligned along a pivot axis such that the lower grip portion is angularly adjustable along the pivot axis relative to the upper grip portion between a plurality of different angular positions, wherein the pivot axis is perpendicular to both the grip axis and the longitudinal barrel axis:

a button coaxially aligned along the pivot axis within the first pivot opening and the second pivot opening;

a locking device operably coupled to the lower grip portion and configured to move axially along the pivot axis between a first position and a second position, wherein the locking device in the first position secures the lower grip portion in one of the plurality of different angular positions relative to the upper grip portion, and the locking device in the second position releases the lower grip portion for angular adjustment relative to the upper grip portion about the pivot axis;

a spring configured to bias the locking device axially along the pivot axis toward the first position; and a button operably coupled to the locking device and coaxially aligned with the pivot axis, wherein depressing the button opposes the bias of the spring and moves the locking device axially along the pivot axis toward the second position.

7. The adjustable handgrip of claim 6 further comprising a button retainer configured to limit axial movement of the button and the locking device in a direction from the second position toward the first position.

8. The adjustable handgrip of claim 7 wherein the button retainer includes:

a button retention cap opening supported by the lower portion and coaxially aligned along the pivot axis; and a button retention cap coaxially aligned along the pivot axis within the button retention cap opening and operably coupled to the button.

9. The adjustable handgrip of claim 6 including:

a spring retainer coaxially aligned along the pivot axis and secured to the lower grip portion;

wherein the spring includes a first end engaging the spring retainer and a second end engaging the locking device.

10. The adjustable handgrip of claim 6 wherein the locking device includes:

a locking drum coupled to the lower grip portion and including a plurality of circumferentially spaced locking teeth; and wherein the upper grip portion includes a plurality of circumferentially spaced cooperating teeth axially aligned with the first pivot opening and supported by the downwardly extending lobe, the locking teeth of the locking drum configured engage with the cooperating teeth of the upper grip portion.

11. The adjustable handgrip of claim 10, wherein the locking drum further includes a guide sleeve extending axially opposite the locking teeth of the locking drum, the guide sleeve receiving an end of the spring.

12. The adjustable handgrip of claim 6, further comprising a fastener securing the locking device to the button.

13. The adjustable handgrip of claim 6, further comprising a plug, wherein the lower grip portion includes a third pivot opening coaxially aligned with the first pivot opening and the second pivot opening along the pivot axis, the second pivot opening positioned intermediate the first pivot opening and the third pivot opening, the plug being received within the third pivot opening.

14. A method of operating an adjustable handgrip for a firearm, the method further comprising the steps of:

providing a firearm comprising a body including a barrel extending along a longitudinal barrel axis:

providing an adjustable handgrip with an upper grip portion, a lower grip portion, and a button, wherein the upper grip is coupled with the body so as to extend away from the longitudinal barrel axis along a grip axis:

depressing the button to an actuated position, wherein a locking device releases the lower grip portion for rotational movement relative to the upper grip portion about a pivot axis, wherein the pivot axis is perpendicular to both the grip axis and the longitudinal barrel axis:

rotating the lower grip portion of the adjustable grip relative to the upper grip portion about the pivot axis to a user desired angle of use; and releasing the button wherein the locking device is biased to a locked position to secure the lower grip portion at the user desired angle relative to the upper grip portion of the adjustable handgrip, wherein the locking device includes:

a locking drum including a plurality of circumferentially spaced locking teeth wherein the locking device includes locking drum with teeth; and wherein the upper grip portion includes a plurality of circumferentially spaced cooperating teeth configured to engage with the locking teeth of the locking drum.

15. The method of operating of claim 14, further comprising a spring operably coupled to the locking device, wherein the locking device is configured to move axially along the pivot axis between a first position and a second position, wherein the locking device in the first position secures the lower grip portion in one of the plurality of different angular positions relative to the upper grip portion, and the locking device in the second position releases the lower grip portion for angular adjustment relative to the upper grip portion about the pivot axis, the spring being configured to bias the locking device along the pivot axis toward the first position.

* * * * *